United States Patent [19]

Balck, Jr.

[11] 4,271,647

[45] Jun. 9, 1981

[54] PRESTRESSED CONCRETE TANKS WITH SHEAR BLOCKS FOR RESISTING SHEARING FORCES

[75] Inventor: Lars Balck, Jr., Gainsville, Fla.

[73] Assignee: The Crom Corporation, Gainesville, Fla.

[21] Appl. No.: 75,316

[22] Filed: Sep. 13, 1979

[51] Int. Cl.[3] ..... E04H 7/20; B65D 88/76

[52] U.S. Cl. ..... 52/169.4; 52/167; 52/224; 52/264; 52/293; 52/396; 264/32; 264/34

[58] Field of Search ..... 52/167, 224, 264, 334, 52/396, 573, 293; 264/32, 34

[56] References Cited

U.S. PATENT DOCUMENTS

| | | | |
|---|---|---|---|
| 2,755,630 | 7/1956 | Freyssinet | 52/293 X |
| 2,932,964 | 4/1960 | Dobell | 52/224 |
| 3,106,227 | 10/1963 | Crowley | 52/224 X |
| 3,120,047 | 2/1964 | Crom | 264/32 |
| 3,233,376 | 2/1966 | Naillon et al. | 52/167 X |
| 3,385,016 | 5/1968 | Crom | 52/224 |
| 3,822,520 | 7/1974 | Crom, Jr. | 52/224 |

FOREIGN PATENT DOCUMENTS

| | | | |
|---|---|---|---|
| 667419 | 6/1929 | France | 52/334 |
| 1305499 | 8/1962 | France | 52/396 |

*Primary Examiner*—Alfred C. Perham

[57] ABSTRACT

Disclosed is a prestressed concrete tank comprising a foundation having a generally horizontal supporting surface and a wall structure mounted on the supporting surface. The generally horizontal supporting surface is provided with at least two shear blocks which have sufficient height as to project upwardly from the top of the supporting surface. The wall structure supported by the supporting surface partially surrounds the projecting portion of the shear blocks in a fashion so as to allow for the wall structure to be sealingly supported by the supporting surface; at the same time, however, the shear blocks tend to resist shearing forces on the tank caused by backfilling, earthquakes and the like, which could cause displacement and/or rotation of the tank wall structure relative to the foundation. The shear blocks may be formed as integral portions of the generally horizontal supporting surface or may comprise separate, generally box-like elements which are positioned within cavities formed in the supporting surface.

43 Claims, 5 Drawing Figures

PRESTRESSED CONCRETE TANKS WITH SHEAR BLOCKS FOR RESISTING SHEARING FORCES

BACKGROUND OF THE INVENTION

The present invention is directed generally to prestressed concrete tanks used for storing liquids such as water and, more particularly, to such prestressed concrete tanks having means for preventing the wall of the tank from rotating and/or from shifting laterally relative to the tank foundation when subjected to shearing forces, such as occur during backfilling earthquakes, and the like.

As a brief background, conventional prestressed concrete tanks generally comprise an annular-shaped supporting foundation embedded in the earth and a vertically extending cylindrical wall structure of concrete about a cylindrical steel shell. The outer concrete portion of the wall structure is generally prestressed by a plurality of circumferential steel wires under a tension of up to about 140,000 psi or more. Prestressing of the wall structure of the tank maintains the concrete in compression even when the tank is filled with a liquid. The wall structure of the tank is not necessarily fixed to the foundation, but, may instead simply rest on the foundation so that the wall structure is able to move or float horizontally with respect to the foundation. An elastomeric gasket type seal (e.g. PVC) is utilized between the wall structure and the foundation to prevent liquid contained in the tank from escaping between the bottom of the wall structure and the foundation.

The capability for limited movement of the wall structure relative to the foundation is necessary during the construction of the tank and during its service life since, as the prestressing circumferential steel wires are stressed, the radius of the wall structure is reduced as well as when the concrete material of the wall structure cures. Furthermore, when the completed tank is filled with or simply contains a liquid, hydrostatic pressure of the liquid causes a radial expansion of the wall structure. In both instances, the wall structure must move relative to the foundation of the tank to prevent harmful stresses from being created, both in the wall structure and the foundation.

However, a capability of almost unlimited movement of the wall structure relative to the foundation is undesirable and even catastrophic when the wall structure is subjected to large horizontal shearing forces. An example of the occurrence of such shearing forces is during the backfilling of the tank. To be more specific, in many instances the terrain on which a tank is to be constructed is not level but is instead sloped, e.g., on the side of a hill. Consequently, prior to construction of the tank, earth is excavated from the hillside to provide a level base for the tank. Once the tank is completed, earth is backfilled along the uphill side of the wall structure of the tank to insure adequate drainage and to prevent erosion about the foundation of the tank. Backfilling on only a portion of the wall structure, however, creates shearing forces which tend to displace the wall structure off the foundation in the downhill direction, or at least tend to cause the wall structure to slide across the foundation. Another example of the occurrence of such forces is during an earthquake or earth tremor wher unequal shearing forces on the tank can be expected from any direction and which will tend to displace the wall structure.

Consequently, it is oftentimes necessary to provide means in a concrete tank which can help resist the occurrence of these shearing forces and thereby help prevent large displacements of the wall structure of the tank relative to the foundation while still allowing for necessary limited movement of the wall structure during construction of the tank and upon filling the completed tank with liquid.

An example of a known prestressed concrete tank which does include such means is disclosed in U.S. Pat. No. 2,932,964 to Dobell. In this tank, an overlap between an elevated peripheral step on the foundation and a protrusion on the interior of the wall structure provides a key to assure that the tank will stay on its foundation during earthquakes and to maintain the tank in position when the tank is backfilled unevenly and movement occurs. However, means are not provided in the disclosed tank to prevent rotational displacement as well as lateral displacement of the wall structure relative to the foundation.

Furthermore, U.S. Pat. No. 3,233,376 to Naillon et al discloses structural shear units adapted for use in concrete tanks. These units are devices which provide a connection between a supporting structure such as a tank foundation and a supported structure such as a tank wall, and which permit relative motion due to loading, prestressing or seismic stress. The disclosed structural shear units each comprise a lower member and an upper member slidably supported on the lower member, the members being respectively secured to the supporting structure and to the supported structure. The members have mutually engageable elements such as pairs of laterally directed abutments extending horizontally generally along the axis of the desired free sliding movement for restraining or limiting horizontal sliding motion between the members in the direction perpendicular to the axis. To reduce friction, an anti-friction pad such as a sheet of porous metal inpregnated with a lubricant is placed between the members.

SUMMARY OF THE INVENTION

It is therefore an object of the present invention to provide means for resisting shearing forces in a concrete-type tank in which the sealing means is less complicated and less expensive.

Another object of the present invention is to provide means for resisting shearing forces in a concrete-tye tank which are relatively easily fabricated and whose installation can easily be integrated in conventional methods for the construction of such tanks.

A further object of the present invention is to provide shear blocks for use in a prestressed concrete tank which can resist shearing forces on the tank caused, for example, by backfilling, earthquakes, and the like, which forces could normally cause displacement of the tank wall structure relative to the foundation.

A further object of the present invention is to provide a method for making watertight, prestressed concrete tanks wherein means such as shear blocks are included in the tanks to resist shear forces on the tanks caused by, for example, backfilling, by earthquakes, and the like.

Briefly, these objects are achieved by the present invention which in its broader aspects comprehends use of at least two shear blocks in a concrete-type tank having a foundation and a wall structure to help resist shearing forces between the wall structure and the foundation, the shear blocks each comprising a mass of reinforced concrete material in the general shape of an elongated hexahedron. The present invention also includes a tank comprising a foundation having a generally horizontal suporting surface and at least two shear blocks having sufficient height to project upwardly from the top of the supporting surface so as to be partially surrounded by the wall structure which is sealingly supported on the supporting surface.

The present invention further comprehends a method for making a tank which comprises a foundation having a supporting surface and a wall structure on the supporting surface, the method comprising the steps of (a) forming the foundation with a generally horizontal supporting surface so as to integrally include at least two shear blocks extending upwardly from the top of its supporting surface, (b) constructing a vertical portion of the wall structure of the tank on the supporting surface of the foundation adjacent to each shear block so as to include a liquid seal means between the vertical wall structure portion and the supporting surface of the foundation, and (c) completing the remainder of the wall structure so as to partially enclose the projecting portions of each of the shear blocks, but also so as to include means forming a bond breaker between the remaining wall structure and the supporting surface. Alternatively, the method may comprise the steps of (a) forming the foundation with a generally horizontal support surface so as to include at least two cavities therein, (b) constructing a vertical portion of the wall structure of the tank on the supporting surface of the foundation adjacent to each cavity so as to include a liquid seal means between the vertical wall structure portion and the supporting surface of the foundation, (c) placing a preformed shear block in each cavity, each shear block having a portion extending vertically upwardly beyond the top of the supporting surface of the foundation, and (d) completing the remainder of the wall structure so as to partially enclose the projecting portions of each of the shear blocks, but also so as to include means forming a bond breaker between the remaining wall structure and the supporting surface.

Further objects, advantages and features of the present invention will become more fully apparent from a detailed consideration of the arrangement and construction of the constituent parts as set forth in the remainder of the specification taken together with the accompanying drawing.

DESCRIPTION OF THE PREFERRED EMBODIMENTS

Figure 1:
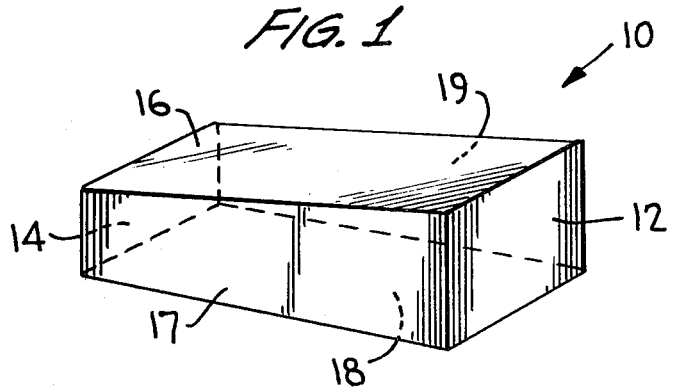
FIG. 1 is a perspective view of one embodiment of a shear block in accordance with the present invention.

Referring now to FIG. 1, one embodiment of a shear block 10 in accordance with the present invention is shown which is adapted to be utilized in a prestressed concrete tank. Shear block 10 is generally of an elongated box-type configuration except that front end surface 12 has a greater height than back end surface 14, such that the top side surface 16 of the block 10 slopes downwardly relative to the bottom side surface 18 of the block. The shape of the shear block 10 can be generally described as an elongated hexahedron having generally rectangular end surfaces 14 and 12, generally rectangular top and bottom surfaces 16 and 18, and generally trapezoidal side surfaces 17 and 19. Although the various surfaces may all be planar (the opposite side surfaces 17 and 19 may, however, be both curved as if forming segments of coincident cylinders), all opposite surfaces may not be parallel. In this regard, and as noted above, the top side surface 16 will converge towards the bottom side surface 18 as it extends from the front end surface 12 to the back end surface 14. In addition, the generally rectangular end surfaces 14 and 12 will converge to some extent towards one another, i.e., towards a distant imaginary common intersection line. More specifically, they will converge towards an imaginary vertical center line which will vertically pass through the center of the wall structure of the tank in which they are used, thus allowing for free inward movement of the wall structure (as will be better understood by the discussion which follows). Depending on the size of the tank and the size (diameter) of the wall structure of the tank in which they are used, the convergence of the end surfaces 14 and 12, as defined above, will vary.

Figure 4:
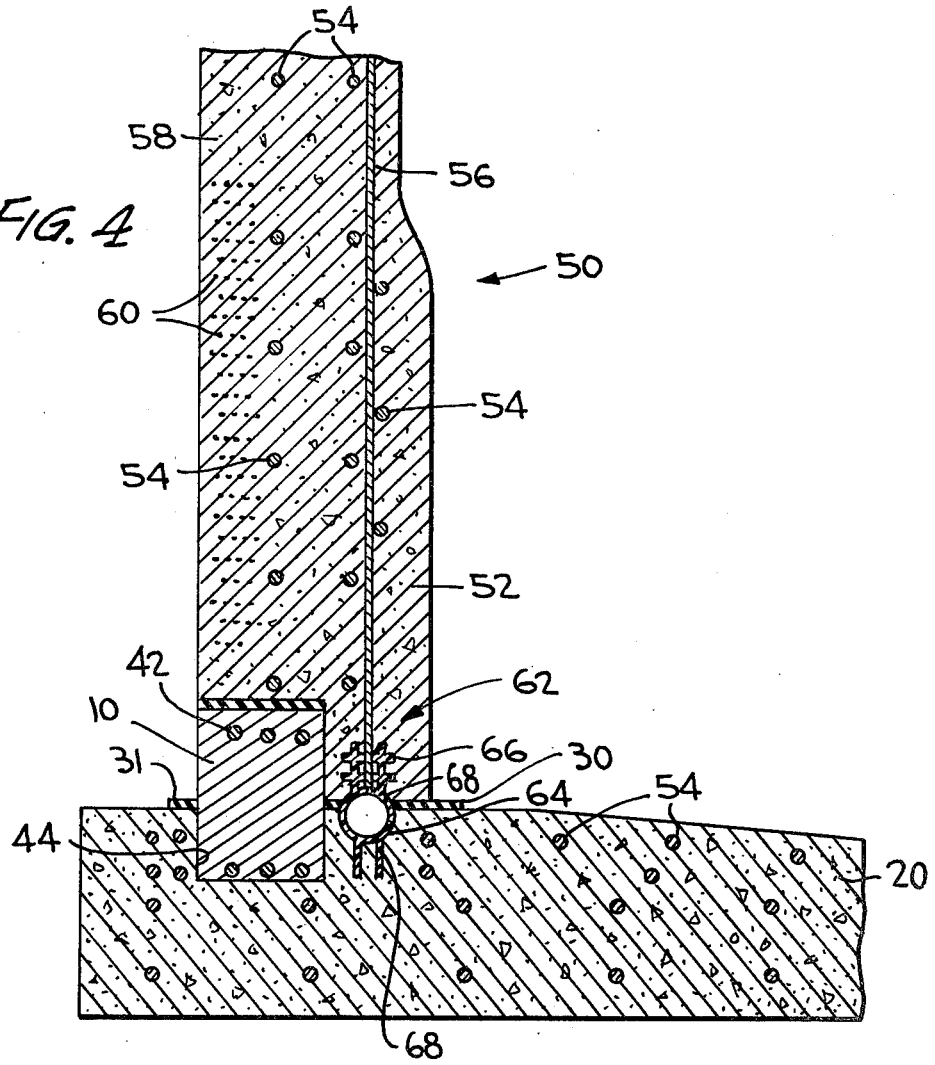
FIG. 4 is a vertical cross-sectional view taken along a radius of a prestressed concrete tank utilizing shear blocks as shown in FIG. 1.

The preferred shear blocks 10 of the invention are formed of concrete material which has been solidified around steel reinforcing bars (indicated in FIG. 4 only).

Figure 2:
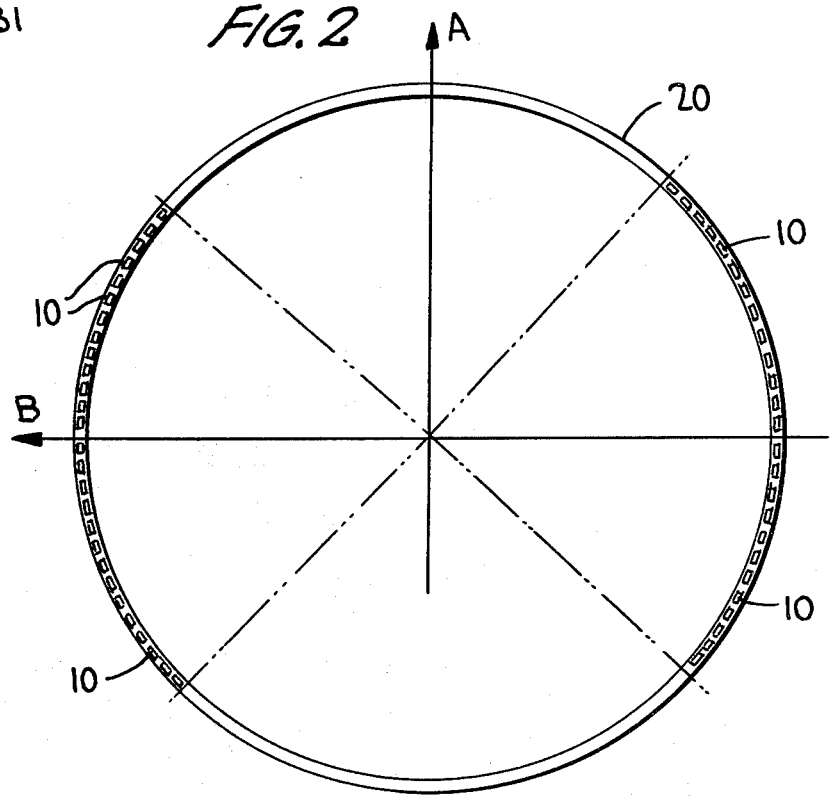
FIG. 2 is a plan view of the foundation for a prestressed concrete tank illustrating a preferred placement of shear blocks when backfilling shear forces are expected on the tank.

One situation wherein shear blocks 10 are advantageously used in a prestressed concrete tank is illustrated in FIGS. 2–5, which relate to a situation wherein shear forces from backfilling are encountered. FIG. 2 is a plan view of foundation 20 of a circular prestressed concrete tank showing a preferred location for shear blocks 10 about the circumference of the foundation. It should be realized that foundation 20 as illustrated is only that portion of the complete foundation which supports the wall structure for the tank. The complete foundation would, of course, extend across and fill in the portion defined by supporting foundation 20.

In FIG. 2, arrow A indicates the uphill direction of the terrain on which foundation 20 is located. In this embodiment, shear blocks 10 are placed in foundation 20 on the uphill arc of about 53° from direction B perpendicular to the uphill direction and an adjoining downhill arc of about 48° from direction B, the total arc comprising a segment of less than about 100°. Shear blocks 10 are located in foundation 20 such that the blocks project upwardly from the supporting surface of the foundation and the larger front surface 12 of each block faces generally uphill.

Figure 3:
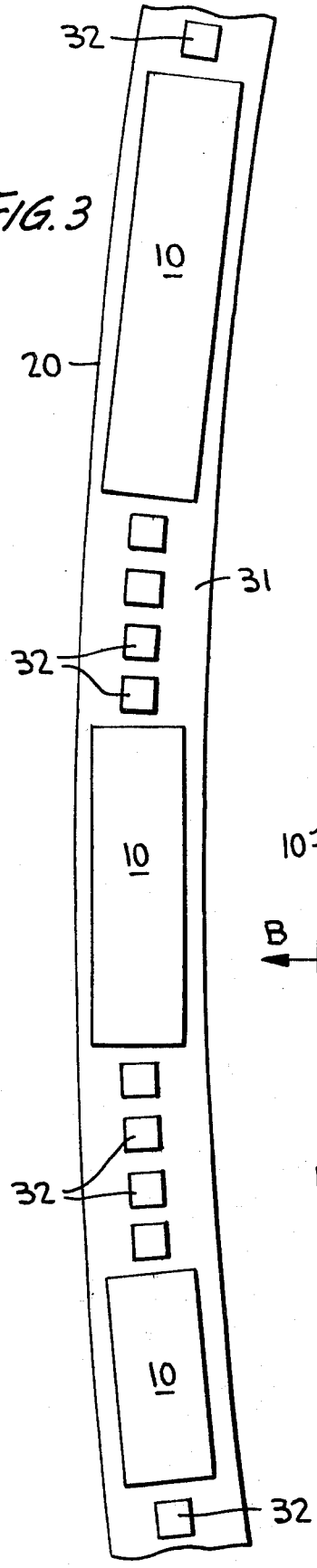
FIG. 3 is an enlarged view of a portion of the foundation shown in FIG. 2.

The placement of shear blocks 10 in foundation 20 is more clearly shown in FIG. 3 which is an enlarged plan view of a portion of the foundation shown in FIG. 2. A series of shear blocks 10 are partially embedded within cavities (not shown) in foundation 20 such that front surfaces 12 face generally uphill. As is illustrated, shear blocks 10 of the series which are nearer the uphill side of the foundation may have a greater length than those shear blocks nearer the downhill side.

Overlying foundation 20 are an inner annular bond breaker 30 and an outer annular bond breaker 31, the outer bond breaker 31 preferably having square openings therein which contain bearing pads 32. Bond breakers 30 and 31 and bearing pads 32, when needed, help provide a flexible barrier between foundation 20 and a vertical tank wall (not shown) which is supported by the foundation. Bond breakers 30 and 31, and particularly pads 32, also help provide a smooth surface so that the wall structure (not shown) of the tank can easily move relative to foundation 20 during prestressing and the like. Without gaskets 30 and 31, and pads 32, if used, any movement of the wall structure relative to foundation 20 would be between concrete surfaces which, due to high friction generated, could cause structural damage to the tank.

Figure 5:
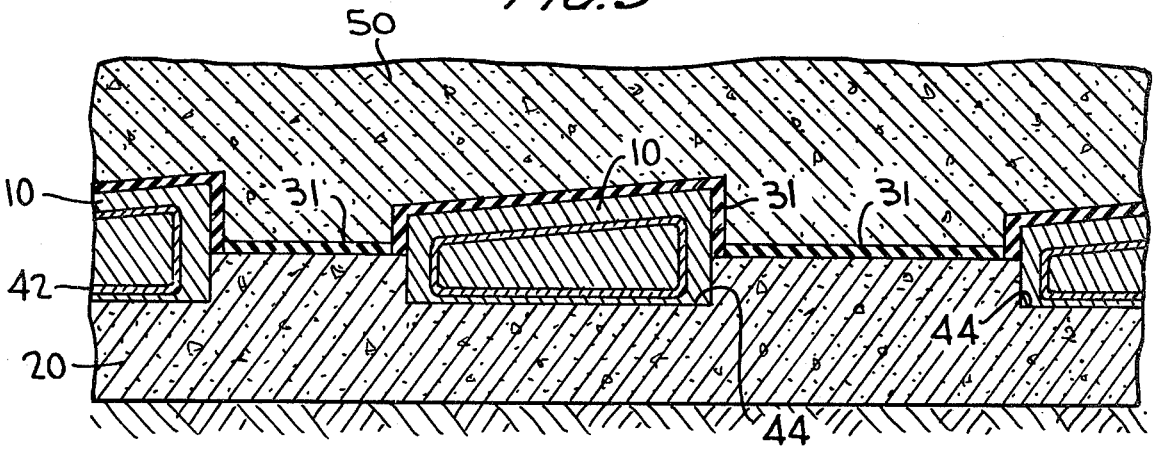
FIG. 5 is another vertical cross-sectional view of the prestressed tank as shown in FIG. 4, the view being transverse to the view shown in FIG. 4.

The interaction among shear blocks 10, the foundation, and the wall structure of a prestressed concrete tank are shown in FIGS. 4 and 5 which are cross-sectional views of a portion of a complete tank, the interior portion of the tank in FIG. 4 being to the right. In these Figures, shear block 10, having internal reinforcing bars 42, rests in a cavity 44 formed in foundation 20. As is apparent, cavity 44 is of a depth such that shear block 10 projects a certain distance above the top of the supporting surface of foundation 20.

Wall structure 50, supported by foundation 20 and shear block 10, comprises an inner concrete portion 52 reinforced by steel bars 54, cylindrical steel shell 56 and outer concrete portion 58 also having reinforcing bars 54. Outer concrete portion 58 is prestressed by circumferential wires 60 in a conventional manner. Separating wall structure 50 from foundation 20 and block 10 are bond breakers 30 and 31 and pads 32, as were previously illustrated in FIG. 3. Sealing means 62, comprising tubular bulb 64 and extending arms 66 filled with solidifiable material 68, such as epoxy, helps to provide a fluid-tight seal between wall structure 50 and foundation 20.

To further explain the purpose and effect of the use of shear blocks 10 in accordance with the present invention, attention is again directed to FIG. 2 which shows a preferred placement of shear blocks 10 in a tank relative to the terrain on which the tank is constructed. Once the tank is fully constructed, it is necessary to backfill with earth on the uphill side of the tank to provide adequate drainage and thereby to prevent erosion of the earth adjacent to the foundation. If the slope of the terrain is quite steep, earth may have to be backfilled almost to the top of the wall structure on the uphill side while little or no backfilling is necessary on the downhill side. Consequently, backfilling in this manner creates large shear forces on the tank generally in the downhill direction. The use of shear blocks 10 tends to resist these shear forces and help prevent displacement of the wall structure relative to the foundation. By visualizing a top view of the tank, shear blocks 10 form an arch with the wall structure to resist the shear forces caused by backfilling. Since the forces are first resisted by the furthermost uphill shear blocks 10, preferably those blocks are larger in size than the remaining blocks. In addition, by having the larger front face 12 of shear blocks 10 facing uphill, a larger effective area is available to resist forces while minimizing the shear block volume.

It should be realized, however, that, if desired, blocks 10 could be placed about the entire periphery of foundation 20 to resist the forces caused by backfilling. Such a placement is, however, less preferred due to the extra time and labor required to install additional shear blocks which are not really necessary for this purpose. In addition, other placement patterns for shear blocks than that shown in FIG. 2 could be utilized, the particular placement pattern depending upon the anticipated forces to which the tank will be subjected.

According to another embodiment of the invention, whenever shear blocks 10 in accordance with the present invention are primarily utilized in a tank to resist shearing forces caused by anticipated earthquakes, the blocks will generally be regularly placed about the entire periphery of foundation 20 as opposed to only a portion as shown in FIG. 2. Such a placement of shear blocks 10 may be necessary since shear forces caused by earthquakes can act on the tank from any direction. By using shear blocks 10 in a tank which may be subjected to the force of an earthquake, displacement or rotation of wall structure 50 relative to foundation 20 may be prevented. In this embodiment, the front and back end surfaces 12 and 14 may be of the same size, such that the upper side surface 16 may in fact be parallel with bottom side surface 18, i.e., since a particular direction of shearing displacement, for which provision must be made, cannot be anticipated.

In one method for constructing a prestressed concrete tank as shown in the drawings, foundation 20 is first cast about appropriate reinforcing bars 54 to a generally circular shape. During casting of foundation 20, cavities 44 of appropriate size are formed in the foundation in the locations shown in FIG. 2. Sealing means 62 and steel shell 56 are then erected, along with appropriate reinforcing bars 54, and annular bond breaker 31 and pads 32 (if used) are placed on the supporting surface of foundation 20 on the outside of the shell. Concrete material is then pneumatically applied to the outer surface of shell 56 and on top of an inner part of bond breaker 31 to form an inner vertical part of outer wall portion 58, extending from the steel shell 56 up to the inner edges of cavities 44. After this, the annular bond breaker 30 is placed on the inside of the shell, and then concrete material is applied to the inside of the shell and on top of the bond breaker 30 to form the inner wall portion 52. Shear blocks 10 of a length and width approximately equal to cavities 44, but of greater height, are then placed in the cavities and a bond breaker material is placed on the top side surfaces 16. Finally, the remainder of outer wall portion 58 of wall structure 50, including prestressing, is then completed; however, it should be noted that the outer wall 58 preferably, but not necessarily, does not extend beyond the outer edge of the shear blocks 10, in any event so as to leave side surfaces 19 of the shear blocks uncovered with any of the outer wall portion 58. This allows for free inner movement of the outer wall portion 58 and the wall structure 50 while retaining the liquid seal between the wall structure 50 and the foundation 20.

It should be noted that during construction of the tank, the inner surface of cavities 44 and associated shear blocks 10 are adjacent to the outer surface of outer wall portion 58 prior to prestressing. Once wall structure 50 is prestressed and the concrete material of the wall structure 50 completely cured, the outer surface of the outer wall portion 58 will become spaced further from the inner surfaces of shear blocks 10 due to radial contraction of the wall structure. Then, when wall structure 50 is completed, a space will remain between the inner surface of shear blocks 10 and the wall structure so as to allow for radial expansion of the wall structure due to hydrostatic pressure of a liquid contained in the tank.

As was described previously, the use of shear blocks 10 in a prestressed concrete tank tends to resist shear forces between foundation 20 and wall structure 50 of the tank caused by, for example, backfilling of the tank, or earthquakes. Thus, a tank utilizing such shear blocks 10 will have a greater ability to withstand such shear forces and will thereby provide a tank having improved stability and fluid tightness under adverse conditions.

Furthermore, the use of shear blocks 10 also helps to resist forces which might cause the wall structure to rotate circumferentially relative to the foundation. By utilizing the preferred shape for shear blocks 10 in FIG. 1 and placing the blocks such that the larger front surface 12 is directed towards the anticipated forces, a greater area of the blocks is exposed to the forces and thereby provides greater stability for the tank without utilizing massive blocks.

Although the above-described preferred embodiment utilizes a single unitary shear block 10 within each cavity 44 of foundation 20, it is within the scope of the present invention to utilize two or more individual shear blocks within a single cavity. Each shear block 10 may then be made of a corresponding smaller size so as to facilitate handling and placement of the blocks within cavities 44 of foundation 20. In addition, and according to another embodiment of the invention, instead of comprising separately formed elements, shear blocks 10 could be integrally formed during the construction of foundation 20 so that the shear blocks comprise integral projections from the foundation. This alternative is perhaps less preferred since the projecting shear blocks 10 may interfere with or impede the construction of outer wall portion 58 of the wall structure 50.

The particular size of shear blocks 10 of the present invention is not believed to be critical. The size of blocks 10 will generally vary according to the magnitude of the expected forces to be resisted and the strength of the material used to fabricate the blocks. As was set forth previously, when shear blocks 10 are used to resist shear forces caused by backfilling, preferably the blocks vary in size depending upon their proximity to the expected forces.

To further illustrate the present invention, the following example is given as a particular application of the subject shear blocks in a prestressed concrete tank. It should be realized that the example is presented for the purpose of illustration only and the example does not limit the invention as has heretofore been described.

In a particular application of the present invention in a tank having an outer diameter of approximately 140 feet, thirty shear blocks 10 were utilized on each side of foundation 20, the blocks placed in a pattern as illustrated in FIG. 2. In each group of thirty shear blocks 10, fifteen are on each side of a line perpendicular to the uphill direction. The fifteen downhill shear blocks 10 and the adjacent group of twelve uphill blocks are all of a shape as shown in FIG. 1 and have a length of about two feet, a width of ten inches, a front height of about eight inches and a rear height of about six inches.

Adjacent to the uphillmost block 10 of the twenty-seven identical blocks is a slightly larger block of similar shape having a length of about three feet and the same other dimensions. Adjacent to this latter shear block 10 is a slightly larger block also of similar shape having a length of about four feet, a width of about ten inches, a front face height of ten inches and a rear height of about seven inches. The final shear block 10 nearest to the uphill side of the tank has a length of about five feet, a width of about ten inches, a front face height of about seven inches. All shear blocks 10 are placed in cavities 44 of corresponding lengths and widths and which have a depth of about four inches. Blocks 10 are all spaced about two feet from one another.

While the present invention has been described with reference to particular embodiments thereof, it will be understood that numerous modifications may be made by those skilled in the art without actually departing from the spirit and scope of the invention as defined in the appended claims.

I claim:

1. A storage tank which comprises a foundation having a generally horizontal supporting surface; at least two shear blocks projecting vertically upwardly from the top of said generally horizontal supporting surface; a vertical wall structure supported by said generally horizontal supporting surface, said wall structure including an inner wall portion, a shell means, and an outer wall portion, said shell means being sealingly connected to said generally horizontal supporting surface, said outer wall portion only partially enclosing each of the shear blocks; a first bond breaker means located between said inner wall portion and said generally horizontal supporting surface, and a second bond breaker means located between said outer wall portion and the top side of each of said shear blocks and the generally horizontal supporting surface; said shear blocks, bond breaker means, and shell means allowing for said wall structure to be not only sealed to but radially movable on said generally horizontal supporting surface, yet providing for resistance to shearing forces caused by backfilling, earthquakes, and like occurrences.

2. A storage tank according to claim 1 wherein said wall structure and said first and second bond breaker means are in a generally annular shape.

3. A storage tank according to claim 2 wherein a multiplicity of said shear blocks are utilized around the periphery of the portion of said generally horizontal supporting surface which supports said wall structure.

4. A storage tank according to claim 3 wherein said generally horizontal supporting surface includes multiple cavities therein located around the periphery of the portion thereof which supports said wall structure, and wherein at least one separately-formed shear block is positioned in each of said cavities.

5. A storage tank according to claim 4 wherein each shear block is in the general form of an elongated hexahedron, having generally rectangular opposite side surfaces, generally rectangular top, side and bottom surfaces, and generally rectangular front and back end surfaces.

6. A storage tank according to claim 5 wherein said front and back end surfaces of each shear block are planar and converge towards one another, such that their imaginary line of intersection generally coincides with an imaginary vertical center line of said wall structure.

7. A storage tank according to claim 6 wherein said opposite side surfaces of each shear block are planar and parallel.

8. A storage tank according to claim 6 wherein said opposite side surfaces of each shear block are curved as if forming segments of coincident cylinders.

9. A storage tank according to claim 6 wherein said shear blocks are equally spaced apart.

10. A storage tank according to claim 5 wherein each shear block is composed of steel-reinforced concrete.

11. A storage tank according to claim 5 wherein each of the inner wall portion and the outer wall portion of the tank are composed of steel-reinforced concrete.

12. A storage tank according to claim 5 wherein multiple shear blocks are positioned in each of said cavities.

13. A storage tank according to claim 4 wherein each shear block is in the general form of an elongated hexahedron, having generally trapezoidal opposite side surfaces, generally rectangular top side and bottom side surfaces, and generally rectangular front and back end surfaces, the front end surface having a greater height than the back end surface such that the top side surface converges towards the bottom side surface as it extends from the front end surface to the back end surface.

14. A storage tank according to claim 13 wherein said front and back end surfaces of each shear block are planar and converge towards one another, such that their imaginary line of intersection generally coincides with an imaginary vertical center line of said wall structure.

15. A storage tank according to claim 14 wherein said opposite side surfaces of each shear block are planar and parallel.

16. A storage tank according to claim 14 wherein said opposite side surfaces of each shear block are curved as if forming segments of coincident cylinders.

17. A storage tank according to claim 14 wherein said shear blocks are located within two opposed areas, each area defined by a segment of less than 100° of the circumference of the wall structure, and on opposite sides of a line perpendicular to a line extending in an uphill direction when said tank is located on the side of a hill, the front end surfaces of each shear block facing in the uphill direction.

18. A storage tank according to claim 13 wherein each shear block is composed of steel-reinforced concrete.

19. A storage tank according to claim 13 wherein each of the inner wall portion and the outer wall portion of the tank are composed of steel-reinforced concrete.

20. A storage tank according to claim 13 wherein multiple shear blocks are positioned in each of said cavities.

21. A storage tank according to claim 3 wherein said shear blocks are formed integrally with said generally horizontal supporting surface.

22. A storage tank according to claim 21 wherein each shear block is in the general form of an elongated structure having generally rectangular opposite side surfaces, a generally rectangular top side surface, and generally rectangular front and back end surfaces.

23. A storage tank according to claim 22 wherein said front and back end surfaces of each shear block are planar and converge towards one another, such that their imaginary line of intersection generally coincides with an imaginary vertical center line of said wall structure.

24. A storage tank according to claim 23 wherein said opposite side surfaces of each shear block are planar and parallel.

25. A storage tank according to claim 23 wherein said opposite side surfaces of each shear block are curved as if forming segments of coincident cylinders.

26. A storage tank according to claim 23 wherein said shear blocks are equally spaced apart.

27. A storage tank according to claim 22 wherein each shear block is composed of steel-reinforced concrete.

28. A storage tank according to claim 22 wherein each of the inner wall portion and the outer wall portion of the tank are composed of steel-reinforced concrete.

29. A storage tank according to claim 21 wherein each shear block is in the general form of an elongated structure having generally trapezoidal opposite side surfaces, a generally rectangular top side surface, and generally rectangular front and back end surfaces, the front end surface having a greater height than the back end surface such that the top side surface converges towards the top of the supporting surface as it extends from the front end surface to the back end surface.

30. A storage tank according to claim 29 wherein said front and back end surfaces of each shear block are planar and converge towards one another, such that their imaginary line of intersection generally coincides with an imaginary vertical center line of said wall structure.

31. A storage tank according to claim 30 wherein said front and back end surfaces of each shear block are planar and converge towards one another, such that their imaginary line of intersection generally coincides with an imaginary vertical center line of said wall structure.

32. A storage tank according to claim 30 wherein said opposite side surfaces of each shear block are curved as if forming segments of coincident cylinders.

33. A storage tank according to claim 30 wherein said shear blocks are located within two opposed areas, each area defined by a segment of less than 100° of the circumference of the wall structure, and on opposite sides of a line perpendicular to a line extending in an uphill direction when said tank is located on the side of a hill, the front end surfaces of each shear block facing in the uphill direction.

34. A storage tank according to claim 29 wherein each shear block is composed of steel-reinforced concrete.

35. A storage tank according to claim 29 wherein each of the inner wall portion and the outer wall portion of the tank are composed of steel-reinforced concrete.

36. A method of making a storage tank which includes a foundation having a generally horizontal supporting surface, and a wall structure mounted on the supporting surface, the method comprising:

(a) forming a foundation so as to have a generally horizontal supporting surface, said supporting surface having at least two cavities formed therein;

(b) erecting a generally cylindrical steel shell on said supporting surface so as to form a liquid-tight seal therewith, (c) positioning an outer annular bond breaker means on the supporting surface just outside of said cylindrical steel shell, (d) casting an inner vertical part of an outer wall portion of the wall structure against said steel shell and on top of an inner part of the outer annular bond breaker means, said inner vertical wall extending between said steel shell and an inner edge of said cavities, (e) positioning an inner annular bond breaker means on the supporting surface just inside of said cylindrical steel shell, (f) casting an inner vertical wall portion of the wall structure against said steel shell and on top of said inner annular bond breaker means, (g) positioning at least one preformed shear block in each said cavity in the supporting surface, each shear block including a portion projecting upwardly from the top of the supporting surface, and covering a top surface of each shear block with bond breaker means, and (h) casting the remainder of the outer vertical wall portion of the wall structure against the inner vertical part and on top of the remainder of the outer annular bond breaker means and so as to only partly enclose the projecting portion of each shear block.

37. A method according to claim 36 wherein said cavities are formed to be equally spaced apart in a circular fashion in the supporting surface.

38. A method according to claim 36 wherein said cavities are located within two opposed areas, each defined by a segment of less than 100° of the circumference of the wall structure and equally on opposite sides of a line perpendicular to a line extending in an uphill direction when said tank is located on the side of a hill.

39. A method of making a storage tank which includes a foundation having a generally horizontal supporting surface and a wall structure mounted on the supporting surface, the method comprising:

(a) forming the foundation so as to have a generally horizontal supporting surface, said supporting surface having integrally formed therewith at least two shear blocks projecting upwardly therefrom, (b) erecting a generally cylindrical steel shell on said supporting surface so as to form a liquid-tight seal therewith, (c) positioning an outer annular bond breaker means on the supporting surface just outside of said cylindrical steel shell, (d) casting an inner vertical part of an outer wall portion of the wall structure against said steel shell and on top of an inner part of the outer annular bond breaker means, said inner vertical wall extending between said steel shell and an inner part of said shear blocks, (e) positioning an inner annular bond breaker means on the supporting surface just inside of said cylindrical steel shell, (f) casting an inner vertical wall portion of the wall structure against said steel shell and on top of said inner annular bond breaker means, (g) placing bond breaker means on top of each shear block, and (h) casting the remainder of the outer vertical wall portion of the wall structure against the inner vertical part and on top of the remainder of the outer annular bond breaker means and so as to only partly enclose the projecting portion of each shear block.

40. A method according to claim 39 wherein said shear blocks are formed to be equally spaced apart in a circular fashion on the supporting surface.

41. A method according to claim 39 wherein each shear block is formed to have a generally hexahedron shape, but wherein the front and back end surfaces, which are rectangular and planar, converge towards one another, such that their imaginary line of intersection coincides with an imaginary vertical center line of the wall structure; wherein the two opposite side walls are parallel and either planar or curved; and wherein the top side surface is generally parallel with the top of the supporting surface.

42. A method according to claim 39 wherein said shear blocks are located within two opposed areas, each defined by a segment of less than 100° of the circumference of the wall structure and equally on opposite sides of a line perpendicular to a line extending in an uphill direction when said tank is located on the side of a hill.

43. A method according to claim 42 wherein each said shear block is formed to have a generally hexahedron shape, but wherein the front and back end surfaces, which are rectangular and planar, converge towards one another, such that their imarinary line of intersection coincides with an imaginary vertical center line of the wall structure; wherein the two opposite side walls are parallel and either planar or curved; and wherein the top side surface descends from the front end surface to the back end surface, said front end surface of each shear block facing the uphill direction.

* * * * *